US011253902B2

(12) United States Patent
Shibata et al.

(10) Patent No.: US 11,253,902 B2
(45) Date of Patent: Feb. 22, 2022

(54) HEMMING APPARATUS

(71) Applicant: HIROTEC CORPORATION, Hiroshima (JP)

(72) Inventors: Takehiro Shibata, Hiroshima (JP); Sho Takai, Hiroshima (JP)

(73) Assignee: HIROTEC CORPORATION, Hiroshima (JP)

( * ) Notice: Subject to any disclaimer, the term of this patent is extended or adjusted under 35 U.S.C. 154(b) by 552 days.

(21) Appl. No.: 16/178,141

(22) Filed: Nov. 1, 2018

(65) Prior Publication Data

US 2019/0134693 A1 May 9, 2019

(30) Foreign Application Priority Data

Nov. 6, 2017 (JP) ..... JP2017-213816

(51) Int. Cl.
*B21D 39/02* (2006.01)
*B21D 19/08* (2006.01)

(52) U.S. Cl.
CPC ..... *B21D 39/021* (2013.01); *B21D 19/08* (2013.01); *B21D 19/084* (2013.01)

(58) Field of Classification Search
CPC .... B21D 39/021; B21D 19/084; B21D 19/08; B23K 26/352; A41H 5/02; D06B 11/0096; D06B 11/0073; D06B 23/04; D06M 10/005; D06C 5/005; D06C 23/02; D10B 2501/04; B25B 11/00; B25B 11/02
USPC ..... 260/20, 21, 22
See application file for complete search history.

(56) References Cited

U.S. PATENT DOCUMENTS 4,520,646 A * 6/1985 Pauzin ..... B21D 5/045 72/313
2008/0314111 A1* 12/2008 Takemoto ..... B21D 39/021 72/323

FOREIGN PATENT DOCUMENTS

| | | | | |
|---|---|---|---|---|
| DE | 4412232 | A1 * | 10/1995 | ..... B21D 39/02 |
| JP | 2008-229670 | A | 10/2008 | |
| JP | 2008229670 | A * | 10/2008 | |
| JP | 2009-000738 | A | 1/2009 | |
| JP | 2009000738 | A * | 1/2009 | ..... B21D 39/021 |
| JP | 4495184 | B | 4/2010 | |
| JP | 4495184 | B2 * | 6/2010 | |

* cited by examiner

*Primary Examiner* — Joseph J Hail
*Assistant Examiner* — J Stephen Taylor
(74) *Attorney, Agent, or Firm* — Renner, Otto, Boisselle & Sklar, LLP

(57) ABSTRACT

A hem punch is floating-supported to a slide cam by a floating-support mechanism. After the hem punch is moved to be positioned at a pre-hemming start position by a driver cam, preliminary hemming is performed. Subsequently, the hem punch is moved to be positioned at a final-hemming start position by the driver cam, and then the hem punch is moved downward by the floating-support mechanism to perform final hemming.

4 Claims, 9 Drawing Sheets

HEMMING APPARATUS

CROSS-REFERENCE TO RELATED APPLICATION

This application claims priority from Japanese application JP2017-213816 filed on Nov. 6, 2017, the disclosure of which application is hereby incorporated by reference into this application in its entirety for all purposes.

BACKGROUND

The present disclosure relates to a hemming apparatus for hemming workpieces such as metal plates.

In conventional arts, when hemming that is bending of a workpiece such as a door panel for a motor vehicle is performed, a two-step hemming process may be performed in which a bent portion of the workpiece is formed to rise in advance, this bent portion is hemmed until just before it is formed into a final shape, and then is hemmed until it is formed into the final shape. In Japanese Patent No. 4495184, hemming a bent portion until just before it is formed into a final shape is called preliminary hemming, and hemming the bent portion that has been preliminarily hemmed into the final shape is called final hemming.

In a hemming apparatus described in Japanese Patent No. 4495184, a final-hemming part for performing final hemming is formed on a distal-end side of a hem punch and a pre-hemming part for performing preliminary hemming is formed on a base-end side thereof, and this hem punch is attached to a cushion holder with a slide cam interposed therebetween so as to be horizontally slidable. Below the cushion holder, a first gas spring configured to support the cushion holder from below and constantly apply urging force thereto and a second gas spring provided apart from the first gas spring and configured to support the cushion holder when preliminary hemming is completed are provided. On a drive platen disposed opposite to the cushion holder, a driver cam that engages with the slide cam is provided.

When hemming is performed using this hemming apparatus, the drive platen moves downward first, whereby the driver cam is engaged with the slide cam and is moved forward to a position where a pre-hemming part of the hem punch faces the bent portion of the workpiece. Subsequently, when the drive platen further moves downward, the pre-hemming part of the hem punch is moved downward to be pressed against the bent portion of the workpiece, whereby preliminary hemming is performed. From the start of this preliminary hemming, the cushion holder starts to move downward against the urging force of the first gas spring, and when the preliminary hemming is completed, the cushion holder is supported from below by the second gas spring. Subsequently, the slide cam is moved backward by the driver cam, and a final-hemming part of the hem punch faces the bent portion of the workpiece. Subsequently, when the drive platen further moves downward, the final-hemming part of the hem punch is pressed against the bent portion of the workpiece, whereby final hemming is performed to form the bent portion into the final shape.

SUMMARY

The hemming apparatus described in Japanese Patent No. 4495184 can be called a four-motion hemming apparatus because four operations are performed during press stroke, which are an operation of moving the pre-hemming part of the hem punch forward to the position where the pre-hemming part faces the bent portion of the workpiece, an operation of moving the pre-hemming part of the hem punch downward thereby pressing the pre-hemming part against the bent portion of the workpiece, an operation of moving the final-hemming part of the hem punch backward until the final-hemming part faces the bent portion of the workpiece, and an operation of pressing the final-hemming part of the hem punch against the bent portion of the workpiece.

In this four-motion hemming apparatus, after the pre-hemming part of the hem punch is moved forward to the position where the pre-hemming part faces the bent portion of the workpiece, the pre-hemming part of the hem punch can be moved downward to be pressed against the bent portion of the workpiece, and thus processing force does not have to be applied to the bent portion of the workpiece during preliminary hemming. For example, when processing force is applied laterally to a bent portion of a workpiece such as an aluminum member, the bent portion may deform in a manner curling up from its basal portion, which may cause processing accuracy to deteriorate. In view of this, by applying processing force to the bent portion of the workpiece from above, the bent portion of the workpiece can be processed into an intended shape, and thus the processing accuracy can be increased.

However, to the cushion holder, urging force is applied from the first gas spring when the processing is started, and then urging force is applied from the second gas spring when preliminary hemming is completed. In other words, during press stroke, reaction force received by the cushion holder increases stepwise, and furthermore the reaction force onto the cushion holder is generated at separate locations because the first gas spring and the second gas spring are located apart from each other. In addition, a sash inner side of a door sash portion needs to be hemmed, and thus urging force from the gas springs is applied in an unevenly distributed manner. This causes a problem in which a ram on the cushion holder side and the upper platen (drive platen) are more likely to lean during press stroke, and configuration for controlling this leaning is required.

For example, when a sash portion of a vehicle door is hemmed, it is considered that a hem punch is provided for each of a beltline portion, a sash upper-side portion, and a sash rear-side portion, for example, and the press stroke may be wanted to be changed between for the beltline portion and for the sash upper-side portion, for example. In this case, when preliminary hemming and final hemming are to be performed by operation of moving a cushion holder downward as described in Japanese Patent No. 4495184, all hem punches attached to the cushion holder are to move for the same press stroke, and thus the press stroke cannot be changed between for a beltline portion and a sash upper-side portion, for example, which reduces versatility.

The present disclosure has been made in view of the foregoing points, and an object thereof is to increase the versatility when using a four-motion hemming apparatus so that variation in inclination of a cushion holder can be substantially prevented during press stroke and also, when a plurality of hem punches are provided to the cushion holder, press strokes of the respective hem punches can be individually set.

In order to achieve the above-described object, a first aspect of the disclosure is directed to a hemming apparatus for hemming a bent portion that is formed to rise in a peripheral portion of a workpiece in advance, and the hemming apparatus includes: a hemming die for supporting the workpiece; a cushion holder separated from the hemming die and held at a predetermined position by an urging unit; and a drive platen disposed opposite to the cushion holder and configured to be driven in a direction toward or away from the cushion holder. The cushion holder includes: a cushion holder body; a hem punch for hemming the bent portion of the workpiece; a slide cam to which the hem punch is attached; a guide mechanism for attaching the slide cam to the cushion holder body and guiding the slide cam in a direction intersecting a rising direction of the bent portion; and a floating-support mechanism for floating-supporting the hem punch to the slide cam so that the hem punch is capable of being displaced in a direction from a distal end of the bent portion toward a base end thereof. On a base-end side of the hem punch, a pre-hemming part for hemming the bent portion until just before the bent portion is formed into a final shape is formed. On a distal-end side thereof, a final-hemming part for bending the bent portion thus preliminarily hemmed until the bent portion is formed into a final shape is formed. The drive platen includes a driver cam that engages with the slide cam and a pressing mechanism for applying processing force to the hem punch. The driver cam is configured, driven by the drive platen approaching the cushion holder, to move the slide cam toward the bent portion in conjunction with the guide mechanism thereby moving the hem punch to a pre-hemming start position where the pre-hemming part is positioned facing the bent portion, and then move the slide cam backward thereby moving the hem punch to a final-hemming start position where the final-hemming part is positioned facing the bent portion. The pressing mechanism is configured to apply pre-hemming force such that the hem punch is displaced in the direction from the distal end of the bent portion toward the base end thereof when the hem punch is at the pre-hemming start position, and press the hem punch against the bent portion to apply final-hemming force thereto when the hem punch is at the final-hemming start position.

With this configuration, when a workpiece is supported by the hemming die and the drive platen is moved in a direction toward the cushion holder, the driver cam of the drive platen engages with the slide cam and the slide cam is moved toward the bent portion in conjunction with the guide mechanism, whereby the hem punch is positioned at the pre-hemming start position. When the hem punch is at the pre-hemming start position, by the pressing mechanism of the drive platen, pre-hemming force is applied to the hem punch. The hem punch receiving the pre-hemming force presses the bent portion from the distal end toward the base end, whereby the bent portion of the workpiece is preliminarily hemmed.

Subsequently, the driver cam moves the slide cam backward, whereby the hem punch is positioned at the final-hemming start position. When the hem punch is at the final-hemming start position, by the pressing mechanism of the drive platen, the hem punch is pressed against the bent portion, whereby final-hemming force can be applied thereto. At this time, because the hem punch is floating-supported to the slide cam, final hemming can be performed by displacing the hem punch without moving the cushion holder body, and consequently the bent portion is formed into the final shape.

In other words, when a four-motion hemming apparatus is used in the present disclosure, providing the floating-support mechanism for the hem punch eliminates or reduces the need for providing a first gas spring and a second gas spring that apply reaction force stepwise to the cushion holder as in the conventional example. Thus, variation in inclination of a ram (not depicted) and the upper platen (drive platen) caused by reaction force of the cushion holder can be prevented or reduced during press stroke. Although high-pressure gas springs are commonly used as the above-described gas springs, use of the high-pressure gas springs requires, for example, a gas monitoring system involving piping for accurate and reliable operation, which increases man-hours for maintenance. By not using high-pressure gas springs, the structure and maintenance of the hemming apparatus can be simplified, and cost thereof can be reduced.

Furthermore, a plurality of hem punches can be attached to the cushion holder body with the floating-support mechanism interposed therebetween. In this case, the hem punches can be operated individually by the pressing mechanism, and thus the press stroke can be easily changed for each hem punch.

A second aspect of the disclosure is directed to the hemming apparatus according to the first aspect, in which the cushion holder includes: first and second hem punches; first and second slide cams to which the first and second hem punches are respectively attached; first and second guide mechanisms for respectively attaching the first and second slide cams to the cushion holder body and respectively guiding the first and second slide cams each in a direction intersecting a rising direction of the corresponding bent portion; and first and second floating-support mechanisms for respectively floating-supporting the first and second hem punches respectively to the first and second slide cams so that the hem punches are capable of being displaced each in the direction from the distal end of the corresponding bent portion toward the base end thereof. The drive platen includes: first and second driver cams that respectively engage with the first and second slide cams; and first and second pressing mechanisms for respectively applying processing force to the first and second hem punches. Timing when the first pressing mechanism applies processing force to the first hem punch and timing when the second pressing mechanism applies processing force to the second hem punch are different.

With this configuration, the first hem punch and the second hem punch can be individually operated, and thus the press strokes of the first hem punch and the second hem punch can be easily changed.

A third aspect of the disclosure is directed to the hemming apparatus according to the first or second aspect, in which each floating-support mechanism includes a coil spring for urging the corresponding hem punch in an opposite pre-hemming direction.

With this configuration, the floating-support mechanism can be configured with a coil spring that is generally less expensive, and easier to maintain, than a gas spring, and thus cost of the hemming apparatus can be reduced.

A fourth aspect of the disclosure is directed to the hemming apparatus according to the first aspect or the second aspect, in which each pressing mechanism includes: a pre-hemming pressing member for pressing the corresponding cushion holder body to displace the corresponding hem punch in the direction from the distal end of the corresponding bent portion toward the base end thereof when the hem punch is at the corresponding pre-hemming start position; and a final-hemming pressing member for pressing the hem punch to apply final-hemming force to the bent portion when the hem punch is at the corresponding final-hemming start position.

With this configuration, during final hemming, the hem punch is directly pressed by the final-hemming pressing member, whereby greater final-hemming force can be applied to the bent portion of the workpiece. Thus, the forming accuracy of the bent portion can be further increased.

A fifth aspect of the disclosure is directed to the hemming apparatus according to the first aspect or the second aspect, in which the hemming die is formed so as to support a vehicle door having a sash as the workpiece, a plurality of hem punches, including the hem punch, are disposed inside the sash, and each hem punch is formed so as to preliminarily hem and finally hem one of bent portions formed in an inner peripheral portion of the sash.

With this configuration, a plurality of bent portions formed in inner peripheral portions of the sash can be hemmed in one step. This is a very effective method for reducing distortion that occurs all over a product during processing of the sash portion.

By the present disclosure, when the four-motion hemming apparatus is used, variation in inclination of the ram (not depicted) and the upper platen can be prevented or reduced during press stroke, and also the apparatus can be simplified and cost thereof can be reduced. Furthermore, when a plurality of hem punches are provided to the cushion holder, the press strokes of the hem punches can be individually set, whereby versatility can be increased.

DETAILED DESCRIPTION

Figure 1:
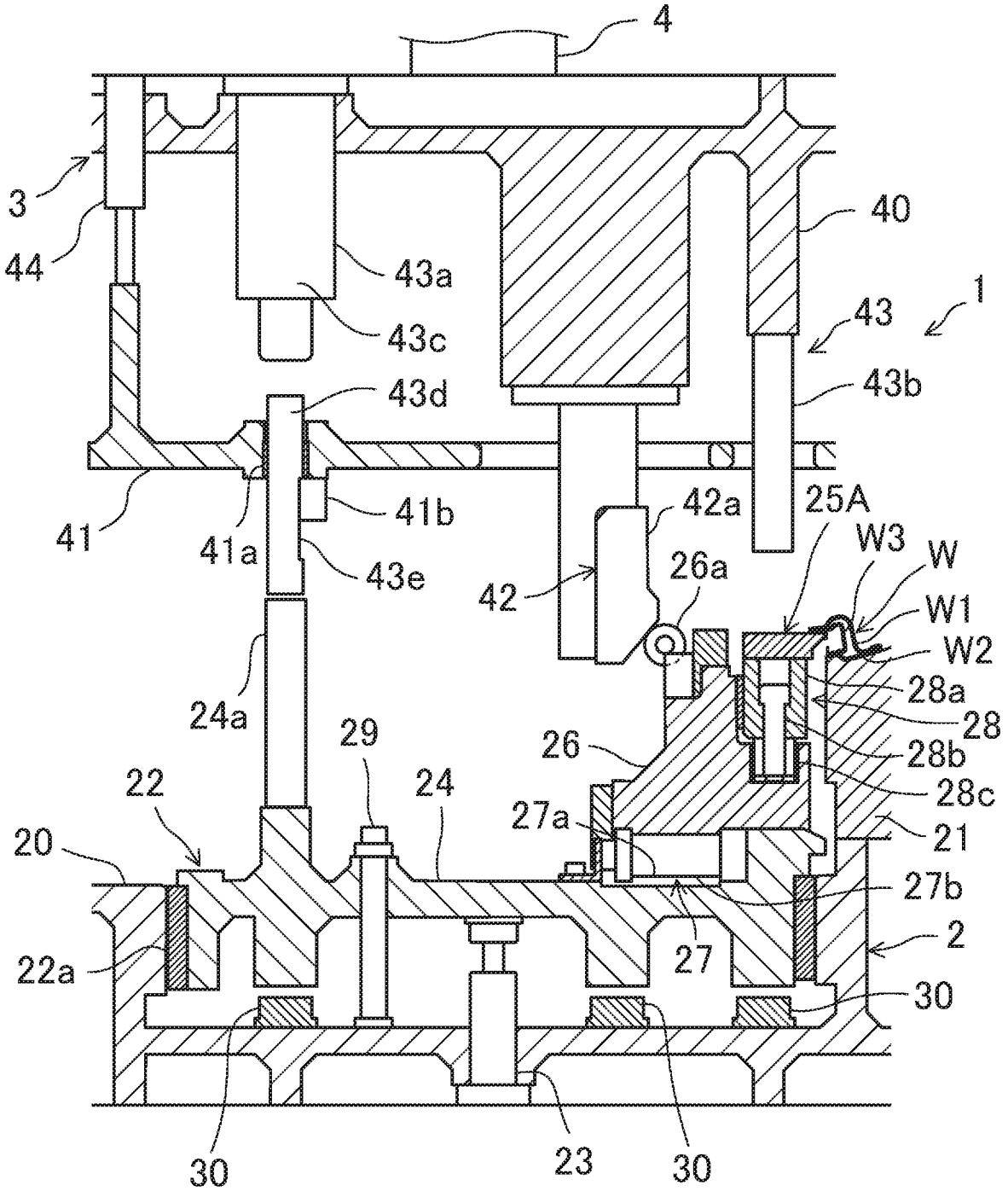
FIG. 1 is a sectional view of a hemming apparatus according to an embodiment of the present disclosure, illustrating a state when a hem punch is near a standby position.

An embodiment of the present disclosure will now be described in detail with reference to the drawings. The following description of the preferred embodiment is merely illustrative in nature, and is not intended to limit the scope, applications, and use of the present disclosure. The sizes and the shapes of respective members illustrated in the drawings are based on one example, and may be changed without departing from the scope of the present disclosure. Furthermore, modifications such as dividing each member into a plurality of parts and forming a plurality of parts into one piece may be made.

Figure 2:
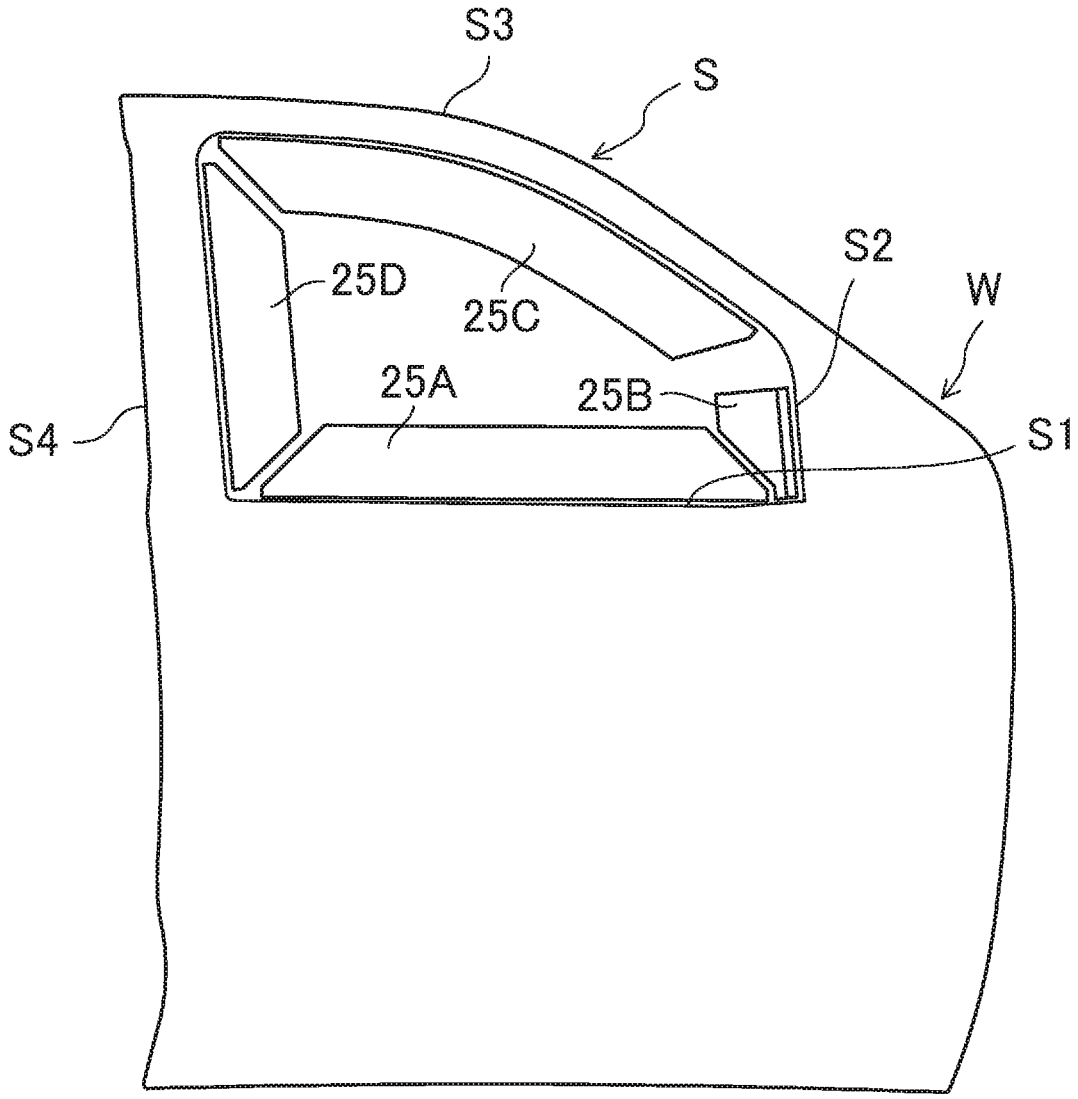
FIG. 2 is a diagram for explaining a positional relation among four hem punches and a workpiece in a planar view, illustrating a state when the hem punches are at standby positions.

FIG. 1 is a sectional view of a hemming apparatus 1 according to the embodiment of the present disclosure. FIG. 2 illustrates a workpiece W and hem punches described later in a planar view. In this FIG. 2, only the workpiece W and the hem punches are illustrated, and other members are omitted.

(Configuration of Workpiece W)

The workpiece W to be processed by this hemming apparatus 1 is a vehicle door as depicted in FIG. 2. However, the workpiece W is not limited to the vehicle door and, for example, various members such as a trunk lid, a hood, and a fender can be used as the workpiece W. In this embodiment, a case where the workpiece W is a vehicle door will be described, and thus respective members constituting the hemming apparatus 1 have shapes set for the vehicle door, and also have structures suitable for forming the vehicle door. However, when the workpiece W has been changed to a different type of workpiece W, the shapes and the structures of the respective members constituting the hemming apparatus 1 only need to be changed so as to be suitable for forming this workpiece W.

A sash portion of the workpiece W is a portion forming what is called a window frame, and is formed so as to hold a peripheral portion of a window glass (not depicted) that is in a closed state. As depicted in FIG. 2, the workpiece W has a beltline portion S1, a sash front-side portion S2, a sash upper-side portion S3, and a sash rear-side portion S4.

As depicted in FIG. 9A to FIG. 9D, the sash portion of the workpiece W includes an inner panel W1, an outer panel W2, and an intermediate member W3 arranged between the inner panel W1 and the outer panel W2. The inner panel W1, the outer panel W2, and the intermediate member W3 can be made of aluminum alloy, for example, but their material is not limited to this. In the outer panel W2 of the workpiece W at an inner peripheral portion of the sash portion S (in a peripheral portion of the outer panel W2), a bent portion W4 is formed.

The hemming apparatus 1 of this embodiment is advantageous because it can apply processing force to the bent portion W4 of the workpiece W1 from the distal end (upper end) of the bent portion W4 toward the base end (lower end) thereof during preliminary hemming, and thus can preliminarily hem this bent portion into an intended shape when the workpiece W is made of aluminum alloy in particular.

Figure 7:
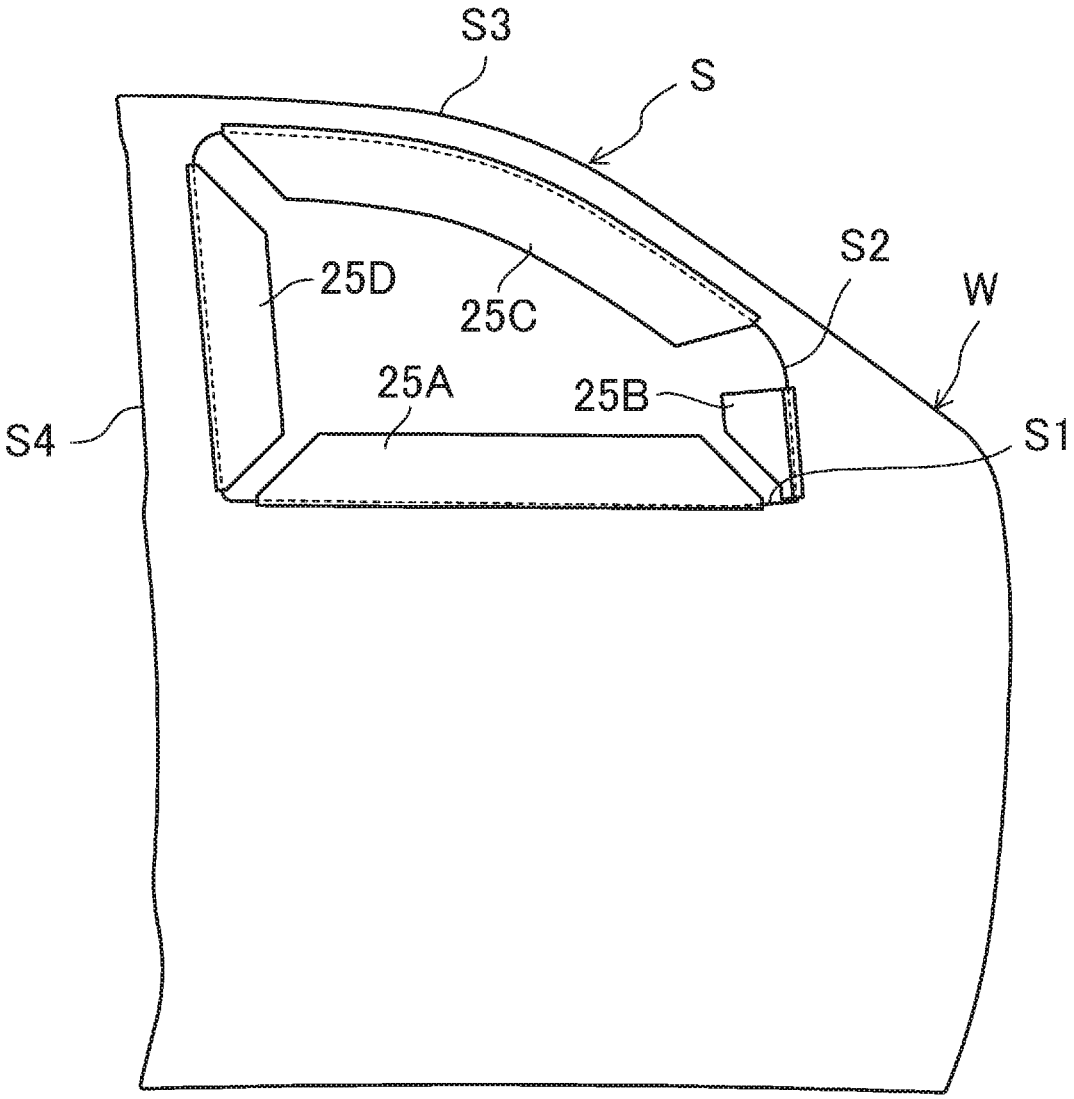
FIG. 7 is a diagram corresponding to FIG. 2, illustrating a state when the final hemming is completed.
Figure 8:
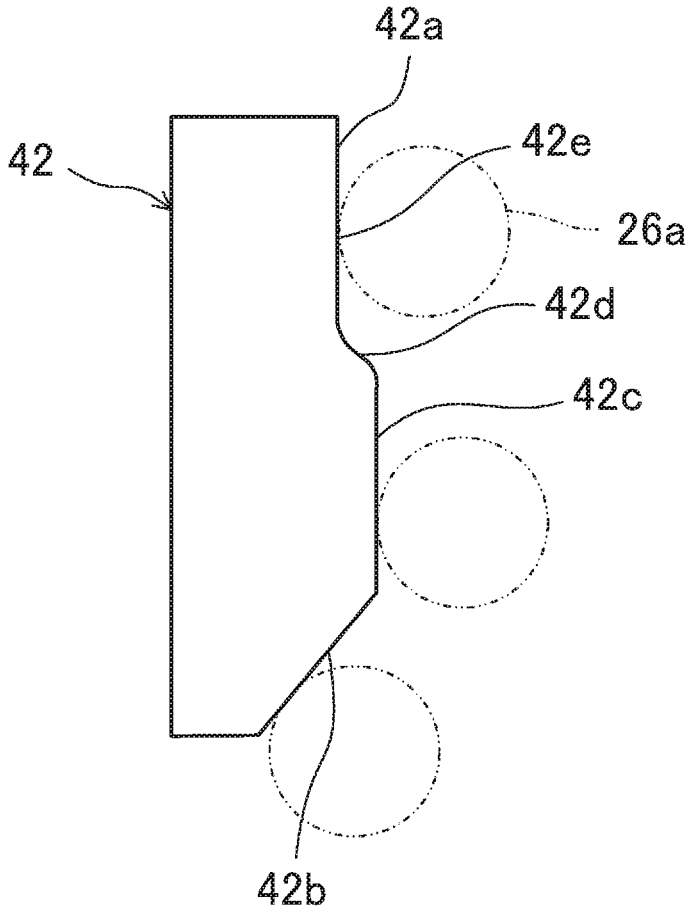
FIG. 8 is a side view of a cam driver.

In FIG. 2 and FIG. 7, the sash portion S of the workpiece W is illustrated, but the bent portion W4 thereof is omitted. The bent portion W4 is illustrated in FIG. 9A to FIG. 9D, for example.

The bent portion W4 of the outer panel W2 is a portion that is formed to rise in advance by another pressing apparatus, and bending this portion with the hemming apparatus 1 is called hemming. By performing this hemming, as depicted in FIG. 9D, the bent portion W4 is brought into contact with the intermediate member W3, whereby the intermediate member W3 is clamped in a thickness direction, and thus the outer panel W2 and the intermediate member W3 can be joined. The bent portion W4 is formed in each of the beltline portion S1, the sash front-side portion S2, the sash upper-side portion S3, and the sash rear-side portion S4.

(General Configuration of Hemming Apparatus 1)

As depicted in FIG. 1, the hemming apparatus 1 includes a lower platen 2, an upper platen (drive platen) 3, a drive unit 4, and a controller (not depicted) for controlling the drive unit 4. The lower platen 2 is installed, for example, on a floor of a factory. The upper platen 3 is disposed right above the lower platen 2, and is movable in a vertical direction that is a direction toward and away from the lower platen 2. The drive unit 4 is a unit for driving the upper platen 3 in the direction toward and away from the lower platen 2, and can be configured with a hydraulic cylinder, for example.

Although details will be described later, the hemming apparatus 1 of this embodiment is what is called a four-motion hemming apparatus configured to be able to perform four operations during press stroke, which are an operation of moving a pre-hemming part 25*b* (illustrated in FIG. 9A to FIG. 9D) of a hem punch 25A forward to a position where the pre-hemming part faces the bent portion W4 of the workpiece W, an operation of moving the pre-hemming part 25*b* of the hem punch 25A downward thereby pressing the pre-hemming part against the bent portion W4 of the workpiece W, an operation of moving a final-hemming part 25*c* of the hem punch 25A backward until the final-hemming part faces the bent portion W4 of the workpiece W, and an operation of pressing the final-hemming part 25*c* of the hem punch 25A against the bent portion W4 of the workpiece W.

(Configuration of Lower Platen 2)

As depicted in FIG. 1, the lower platen 2 includes a lower platen body 20, a hemming die 21 for supporting the workpiece W, and a cushion holder 22. The lower platen body 20 is immovably fixed to a floor, for example, of a factory. To the lower platen body 20, the hemming die 21 is fixed. The hemming die 21 is a high-rigid member for supporting the sash portion S of the workpiece W from below (from the outer panel W2 side), and is formed so as to protrude upward from the lower platen body 20. An upper surface of the hemming die 21 is formed so as to extend along a vehicle outer surface of the outer panel W2, and by bringing this upper surface into contact with the vehicle outer surface of the outer panel W2, the outer panel W2 can be supported.

The cushion holder 22 is separated from the hemming die 21 and the lower platen body 20, and is held at a predetermined position by a lower-platen gas spring 23 as an urging unit. Around the cushion holder 22, a wear plate 22*a* extending vertically is provided, and the cushion holder 22 is guided by this wear plate 22*a* so as to be vertically movable with respect to the lower platen body 20.

The lower-platen gas spring 23 is a member included in the hemming apparatus 1, and is disposed below the cushion holder 22 and fixed to the lower platen body 20. The contracting direction of the lower-platen gas spring 23 is the vertical direction, and the lower-platen gas spring 23 generates urging force that can support the cushion holder 22 from below.

The cushion holder 22 includes a cushion holder body 24, first to fourth hem punches 25A to 25D (illustrated in FIG. 2), first to fourth slide cams 26 (only the first slide cam 26 is illustrated in FIG. 1), first to fourth guide mechanisms 27 (only the first guide mechanism 27 is illustrated in FIG. 1), and first to fourth floating-support mechanism 28 (only the first floating-support mechanism 28 is illustrated in FIG. 1). The first to fourth hem punches 25A to 25D are members for hemming bent portions W4 of the workpiece W, and are disposed inside the sash portion S of the workpiece W as depicted in FIG. 2. The first hem punch 25A is disposed at the beltline portion S1 of the sash portion S of the workpiece W, and hems the bent portion W4 of this beltline portion S1. The second hem punch 25B is disposed at the sash front-side portion S2 of the workpiece W, and hems the bent portion W4 of this sash front-side portion S2. The third hem punch 25C is disposed at the sash upper-side portion S3 of the workpiece W, and hems the bent portion W4 of this sash upper-side portion S3. The fourth hem punch 25D is disposed at the sash rear-side portion S4 of the workpiece W, and hems the bent portion W4 of this sash rear-side portion S4.

Basic structures of the first to fourth hem punches 25A to 25D are the same, and the lengths of the first to fourth hem punches 25A to 25D are different depending on the respective bent portions W4. The planar shapes of the first to fourth hem punches 25A to 25D are also different depending on their arrangement positions in the sash portion S. The following describes the configuration of the first hem punch 25A in detail.

As depicted in FIG. 1, the first hem punch 25A is attached to the first slide cam 26 with the first floating-support mechanism 28 interposed therebetween. As depicted in FIG. 9A to FIG. 9D, on the first hem punch 25A, a forming part 25*a* protruding toward the side closer to the hemming die 21 than the first slide cam 26 is formed. The forming part 25*a* has a pre-hemming part 25*b* for preliminarily hemming the bent portion W4 of the workpiece W and a final-hemming part 25*c* for finally hemming the bent portion W4 of the workpiece W. The preliminary hemming is to hem the bent portion W4 until just before it is formed into a final shape, and specifically is to hem the bent portion until it is formed into the shape depicted in FIG. 9B and FIG. 9C. The final hemming is to hem the bent portion W4 preliminarily hemmed until it is formed into a final shape, and specifically is to hem this bent portion until it is formed into the shape depicted in FIG. 9D.

The pre-hemming part 25*b* is formed on a lower surface of the forming part 25*a* on the side closer to the first slide cam 26 (base-end side), and is formed with an inclined plane that is inclined so as to be located higher as the distance from the first slide cam 26 increases. The final-hemming part 25*c* is formed on a lower surface of the forming part 25*a* on the distal-end side, and is formed with a plane extending substantially horizontally. On an upper-peripheral portion of the inclined plane forming the pre-hemming part 25*b*, a plane forming the final-hemming part 25*c* is continuously arranged.

The first to fourth hem punches 25A to 25D are attached to the first to fourth slide cams 26, respectively. The second to third slide cams (not depicted) are configured in the same manner as the first slide cam 26.

The first slide cam 26 is a member that is provided on an upper surface of the cushion holder body 24 so as to be slidable in the side-to-side direction of FIG. 1. The sliding direction of the first slide cam 26 is a direction intersecting the rising direction of the bent portion W4, and corresponds to the horizontal direction in this embodiment. To an upper portion of the first slide cam 26 on the side opposite to a portion to which the first hem punch 25A is attached, a cam follower 26*a* including a roller is rotatably attached. The rotation axis of the cam follower 26*a* is orthogonal to the sliding direction of the first slide cam 26, and extends horizontally.

The first to fourth guide mechanisms 27 are mechanisms for respectively attaching the first to fourth slide cams 26 to the cushion holder body 24 and respectively guiding the first to fourth slide cams 26 each in a direction intersecting the rising direction of the corresponding bent portion W4. The second to fourth guide mechanisms (not depicted) are configured in the same manner as the first guide mechanism 27.

The first guide mechanism 27 includes side plates 27*a* provided on both sides of the first slide cam 26 and configured to guide the first slide cam 26 in the direction intersecting the rising direction of the bent portion W4 and a coil spring 27*b* for urging the first slide cam 26 in the backward direction. The forward direction of the first slide cam 26 is a direction toward the hemming die 21 (right side in FIG. 1), and the backward direction is a direction away from the hemming die 21 (left side in FIG. 1).

The side plates 27*a* are members for attaching the first slide cam 26 to the cushion holder body 24 such that the first slide cam does not vertically move and does not move in the direction of the rotation axis of the cam follower 26*a*, and the first slide cam 26 is allowed to move only in the direction intersecting the rising direction of the bent portion W4. The coil spring 27*b* is disposed such that its expanding/contracting direction corresponds to the direction intersecting the rising direction of the bent portion W4, and is attached to the cushion holder body 24. The first slide cam 26 engages with this coil spring 27*b*, and thus the first slide cam 26 is constantly urged by the coil spring 27*b*. Instead of the coil spring 27*b*, various types of urging units that can generate urging force may be provided.

The first to fourth floating-support mechanisms 28 are mechanisms for respectively floating-supporting the first to fourth hem punches 25A to 25D to the first to fourth slide cams 26 so that the first to fourth hem punches 25A to 25D can be displaced each in a direction from the distal end of the corresponding bent portion W4 toward the base end thereof (vertical direction). The second to fourth floating-support mechanisms (not depicted) are configured in the same manner as the first floating-support mechanism 28.

The first floating-support mechanism 28 includes a hem-punch fixing member 28*a* to which the first hem punch 25A is fixed, a guide rod 28*b* extending vertically, and a coil spring 28*c*. To an upper surface of the hem-punch fixing member 28*a*, a lower surface of the first hem punch 25A is to be fixed. Inside the hem-punch fixing member 28*a*, an upper-side portion of the guide rod 28*b* is disposed therethrough. This upper-side portion of the guide rod 28*b* is configured to engage with the hem-punch fixing member 28*a* so as not to come off from the hem-punch fixing member 28*a*. The hem-punch fixing member 28*a* is guided by the upper-side portion of the guide rod 28*b* so as to be vertically movable.

The lower-end portion of the guide rod 28*b* is fixed to the first slide cam 26. The coil spring 28*c* is disposed so as to expand and contract in the axial direction (vertical direction) of the guide rod 28*b*, and a lower-side portion of the guide rod 28*b* is disposed through inside the coil spring 28*c*. The lower-end portion of the coil spring 28*c* is in contact with the first slide cam 26 from above, and the upper-end portion of the coil spring 28*c* is in contact with the lower-end portion of the hem-punch fixing member 28*a* from below. Thus, upward urging force is constantly applied to the hem-punch fixing member 28*a* by the coil spring 28*c*, so that the hem-punch fixing member is in a state of floating above the first slide cam 26, that is, in a floating state. Accordingly, the first hem punch 25A is also in a state of floating above the first slide cam 26. In other words, the coil spring 28*c* constantly urges the first hem punch 25A in an opposite pre-hemming direction (upper direction) that is opposite to the direction of preliminary hemming (lower direction).

Instead of the coil spring 28*c*, various types of urging units that can generate urging force may be provided. In addition to the guide rod 28*b*, a guide post (not depicted) for vertically guiding the hem-punch fixing member 28*a* may be provided. The guide rod 28*b* and the guide post are preferably provided in a manner spaced apart from each other in the longitudinal direction of the first hem punch 25A.

The lower platen 2 is provided with a cushion bolt 29. The cushion bolt 29 extends vertically, the lower-end portion thereof is fixed to the lower platen body 20, and the upper-end portion thereof penetrates the cushion holder body 24, and is configured to engage with the cushion holder body 24 from its upper surface. By the cushion bolt 29, the rising-end position of the cushion holder body 24 can be set.

Furthermore, the lower platen 2 is provided with a plurality of press cutting blocks 30. The press cutting blocks 30 are disposed so as to be horizontally spaced apart from each other, and are fixed to the lower platen body 20. The vertical dimension of the press cutting block 30 is set such that, when the cushion holder 22 has moved downward to a pre-hemming completion position described later, lower surfaces of the cushion holder body 24 come into contact with upper-end surfaces of the respective press cutting blocks 30, whereby the cushion holder body 24 is kept from moving to a position lower than the pre-hemming completion position. In other words, the press cutting blocks 30 serve as stoppers for preventing the cushion holder body 24 from moving to a position lower than the pre-hemming completion position.

(Configuration of Upper Platen 3)

The upper platen 3 includes an upper platen body 40, a pad 41, first to fourth driver cams 42 (only the first driver cam 42 is illustrated in FIG. 1), and first to fourth pressing mechanisms 43 (only the first pressing mechanism 43 is illustrated in FIG. 1). The upper platen body 40 is coupled to the drive unit 4, and this upper platen body 40 is directly driven by the drive unit 4.

The pad 41 is formed to substantially horizontally extend in a manner covering the cushion holder 22 from above. The pad 41 is provided with a presser (not depicted) for pressing the workpiece W placed on the hemming die 21 from above to fix the workpiece thereto. The presser is disposed right above the workpiece W, and protrudes downward from a lower surface of the pad 41.

The upper platen 3 is provided with a pad-pressure-source gas spring 44. The pad-pressure-source gas spring 44 is interposed between the upper platen body 40 and the pad 41 such that its expanding/contracting direction corresponds to the vertical direction. When the upper platen 3 moves downward, after the presser comes into contact with the workpiece W and downward movement of the pad 41 is stopped, contraction of the pad-pressure-source gas spring 44 allows the upper platen body 40 to move downward.

The first to fourth driver cams 42 are members configured to respectively engage with the first to fourth slide cams 26 to slide the first to fourth slide cams 26 in the respective guiding directions of the first to fourth guide mechanisms 27 for predetermined lengths at predetermined timings. The second to fourth driver cams (not depicted) are configured in the same manner as the first driver cam 42.

The first driver cam 42 is fixed to a lower surface of the upper platen body 40, and is formed to protrude downward from the lower surface of the upper platen body 40. When the upper platen body 40 is driven by the drive unit 4, the first driver cam 42 moves vertically in conjunction with the movement of the upper platen body 40. On the first driver cam 42, a cam face 42*a* arranged to be in contact with the cam follower 26*a* of the first slide cam 26 is formed. As depicted in FIG. 8 and FIG. 9A to FIG. 9D, the cam face 42*a* has a first cam face 42*b*, a second cam face 42*c*, a third cam face 42*d*, and a fourth cam face 42*e* that are aligned in the order from a lower portion toward an upper portion of the first driver cam 42.

The first cam face 42*b* is formed with a plane that is inclined so as to be located farther in the forward direction of the first slide cam 26 at a higher position from the lower portion of the first driver cam 42. Thus, when the first driver cam 42 has moved downward, force in the forward direction of the first slide cam 26 is applied to the cam follower 26*a* of the first slide cam 26 that is in contact with the first cam face 42*b*, whereby the first slide cam 26 is slid forward against the urging force of the coil spring 27*b* while being guided by the first guide mechanism 27. In other words, the shape of the first cam face 42*b* is determined so that, when the upper platen body 40 approaches the cushion holder 22, the first hem punch 25A can be moved to a pre-hemming start position (illustrated in FIG. 9A) where the pre-hemming part 25*b* is positioned facing the bent portion W4.

The second cam face 42*c* is formed with a plane extending vertically upward continuously from the upper-peripheral portion of the first cam face 42*b*. Thus, even when moving downward, the first driver cam 42 does not move the cam follower 26*a* of the first slide cam 26 that is in contact with the first cam face 42*b* in the forward direction or the backward direction of the first slide cam 26. The second cam face 42*c* is a plane for stopping the first slide cam 26 at a predetermined position.

The third cam face 42*d* is formed with a plane that extends continuously from the upper-peripheral portion of the second cam face 42*c* and is inclined so as to be located closer to the backward side of the first slide cam 26 at a higher position. Thus, when the first driver cam 42 has moved downward, the cam follower 26*a* of the first slide cam 26 that is in contact with the third cam face 42*d* is allowed to move in the backward direction of the first slide cam 26, whereby the first slide cam 26 is slid backward by the urging force of the coil spring 27*b* of the first guide mechanism 27. In other words, the shape of the third cam face 42*d* is determined so that, when the upper platen body 40 approaches the cushion holder 22, the first hem punch 25A can be moved to a final-hemming start position (illustrated in FIG. 9C) where the final-hemming part 25*c* faces the bent portion W4.

The fourth cam face 42*e* is formed with a plane extending vertically upward continuously from the upper-peripheral portion of the third cam face 42*d*. Thus, even when moving downward, the first driver cam 42 does not move the cam follower 26*a* of the first slide cam 26 that is in contact with the fourth cam face 42*e* in the forward direction or the backward direction of the first slide cam 26. The fourth cam face 42*e* is a plane for stopping the first slide cam 26 at a predetermined position.

The cam profile including lengths and inclined angles of the first cam face 42*b*, the second cam face 42*c*, the third cam face 42*d*, and the fourth cam face 42*e* can be optionally determined. In this embodiment, the cam profile is determined so that the position of the first hem punch 25A can be sequentially switched to a standby position indicated by an imaginary line (a long dashed double-short dashed line) in FIG. 9A, the pre-hemming start position indicated by a solid line in FIG. 9A, the pre-hemming completion position illustrated in FIG. 9B, the final-hemming start position illustrated in FIG. 9C, and a final-hemming completion position illustrated in FIG. 9D, and also the first hem punch 25A will not move in the forward/backward direction during preliminary hemming and during final hemming.

The first to fourth pressing mechanisms 43 depicted in FIG. 1 are mechanisms for applying processing force to the first to fourth hem punches 25A to 25D, respectively. The second to fourth pressing mechanisms (not depicted) are configured in the same manner as the first pressing mechanism 43.

The first pressing mechanism 43 includes a pre-hemming pressing member 43*a* and a final-hemming pressing member 43*b*. The pre-hemming pressing member 43*a* is configured to press the cushion holder body 24 downward thereby displacing the first hem punch 25A in a direction from the distal end of the bent portion W1 toward the base end thereof when the first hem punch 25A is at the pre-hemming start position, and includes a pre-hemming gas spring 43*c* and a pre-hemming push bar 43*d*.

The pre-hemming gas spring 43*c* the expanding/contracting direction of which corresponds to the vertical direction has one end portion fixed to a lower surface of the upper platen body 40, and is disposed so as to protrude downward from the lower surface of the upper platen body 40. The urging force of the pre-hemming gas spring 43*c* is force necessary to preliminarily hem the bent portion W4.

The pre-hemming push bar 43*d* vertically extends, is arranged so as to vertically penetrate the pad 41, and is disposed such that the upper-end portion thereof faces the lower-end portion of the pre-hemming gas spring 43*c*. The pre-hemming push bar 43*d* is supported so as to be vertically movable relative to the pad 41. Specifically, to a portion of the pad 41 through which the pre-hemming push bar 43*d* is disposed, a bush 41*a* is fixed, and a vertically middle portion of the pre-hemming push bar 43*d* is disposed therethrough inside this bush 41*a*. On a vertically middle portion of an outer peripheral surface of the pre-hemming push bar 43*d*, a cutout portion 43*e* is formed over a predetermined range. With the cutout portion 43*e*, a stop block 41*b* fixed to the pad 41 is configured to engage, and this engagement prevents the pre-hemming push bar 43*d* from falling off from the pad 41. Herein, the stop block 41*b* is configured not to hinder the relative movement of the pre-hemming push bar 43*d* within the predetermined range.

The lower-end portion of the pre-hemming push bar 43*d* is disposed facing the upper-end portion of a receiving member 24*a* that is provided so as to protrude upward from the cushion holder body 24. Thus, when the upper platen body 40 is driven by the drive unit 4 to move downward, the lower-end portion of the pre-hemming gas spring 43*c* presses the upper-end portion of the pre-hemming push bar 43*d* downward, and the pre-hemming push bar 43*d* thus presses the upper-end portion of the member 24*a* downward, whereby the cushion holder body 24 can be pressed downward.

The final-hemming pressing member 43*b* is a member for pressing the first hem punch 25A downward to apply final-hemming force to the bent portion W4 when the first hem punch 25A is at the final-hemming start position. The final-hemming pressing member 43*b* is formed with a vertically extending bar, for example. The upper-end portion of the final-hemming pressing member 43*b* is fixed to a lower surface of the upper platen body 40. The lower-end portion of the final-hemming pressing member 43*b* is disposed so as to be positioned right above the upper surface of the first hem punch 25A, and thus the lower-end portion of the final-hemming pressing member 43*b* and the upper surface of the first hem punch 25A face each other.

(Hemming Method)

The following describes a case where the hemming apparatus 1 configured as described above is used to hem the workpiece W. The upper platen 3 is moved upward to its rising-end position in advance by the drive unit 4. The rising-end position of the upper platen 3 can be set higher than the position depicted in FIG. 1, and if it is set to this position, the positional relation between the first driver cam 42 and the cam follower 26*a* of the first slide cam 26 corresponds to the positional relation indicated by an imaginary line (a long dashed double-short dashed line) on the right side of FIG. 9A. Thus, the first slide cam 26 moves more backward than the position depicted in FIG. 1, which can prevent or reduce contact between a workpiece W and the forming part 25*a* of the first hem punch 25A when the workpiece W is placed on the hemming die 21 of the lower platen 2.

After the upper platen 3 is positioned at the rising-end position, a workpiece W into which an inner panel W1, an outer panel W2, and an intermediate member W3 are integrated is conveyed by a known robot, for example, and is placed on the hemming die 21 of the lower platen 2. Subsequently, when the upper platen 3 has been moved downward by the drive unit 4, the presser (not depicted) comes into contact with the workpiece W, whereby the workpiece W is held on the hemming die 21. Subsequently, the pad-pressure-source gas spring 44 is contracted by downward movement of the upper platen 3.

Figure 3:
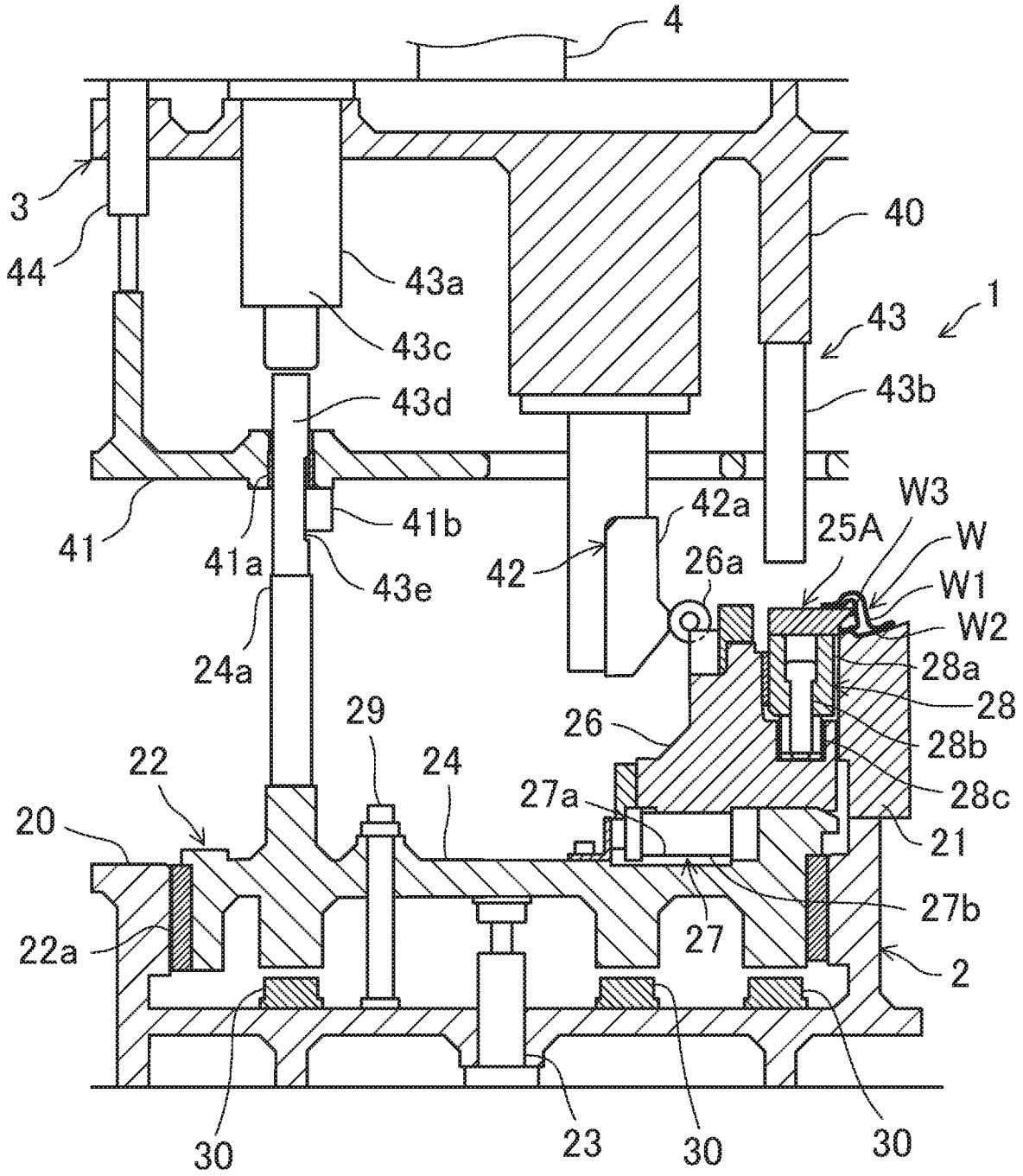
FIG. 3 is a view corresponding to FIG. 1 when the hem punch is at a pre-hemming start position.
Figure 9A:
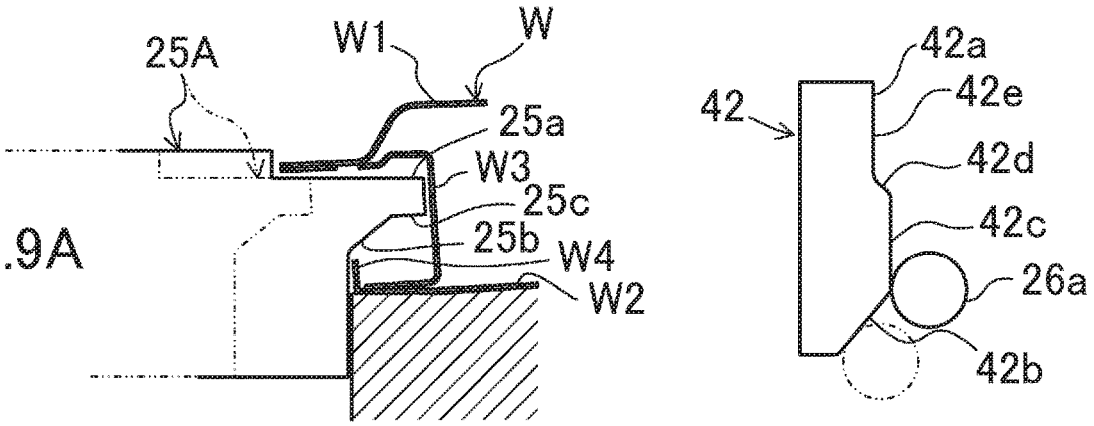
FIG. 9A is a diagram for comparing and explaining a positional relation between a hem punch and a workpiece and a positional relation between a cam driver and a follower, illustrating a state when the hem punch is positioned the pre-hemming start position.

When the upper platen 3 is moved downward by the drive unit 4, the first driver cam 42 is moved downward as indicated by solid lines in FIG. 1 and FIG. 9A, and force in the forward direction of the first slide cam 26 is applied to the cam follower 26*a* of the first slide cam 26 that is in contact with the first cam face 42*b* of the first driver cam 42. Accordingly, the first slide cam 26 is slid forward against the urging force of the coil spring 27*b* while being guided by the first guide mechanism 27, and thus the first hem punch 25A is positioned at the pre-hemming start position (see FIG. 3).

The upper platen 3 continues to be moved downward by the drive unit 4. When the first hem punch 25A is positioned at the pre-hemming start position, the pre-hemming gas spring 43*c* and the pre-hemming push bar 43*d* of the pre-hemming pressing member 43*a* press the cushion holder body 24 downward. Although being held by the lower-platen gas spring 23 at a predetermined position, the cushion holder body 24 moves downward against the urging force of this lower-platen gas spring 23.

Figure 4:
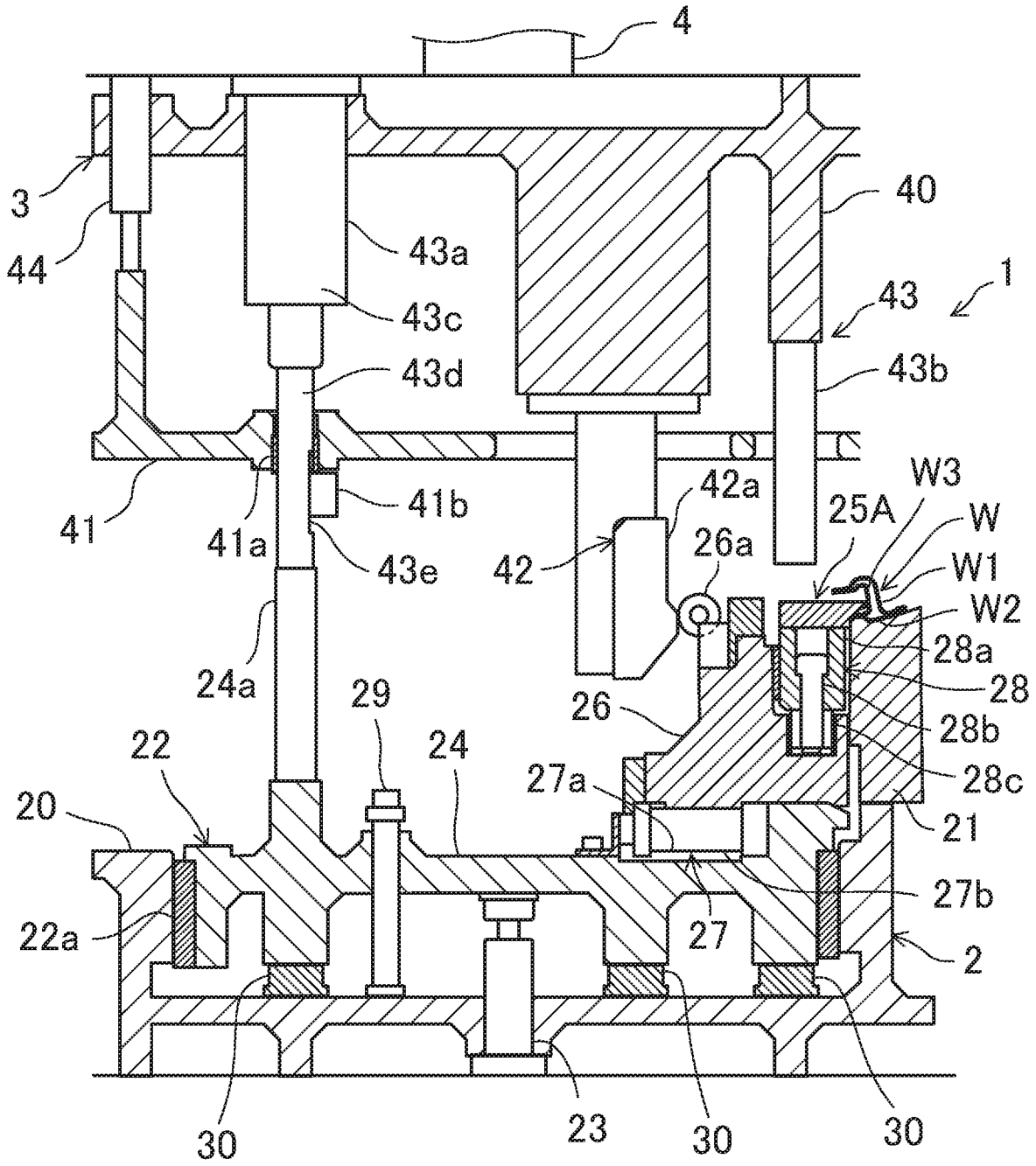
FIG. 4 is a view corresponding to FIG. 1, illustrating a state when preliminary hemming is completed.
Figure 9B:
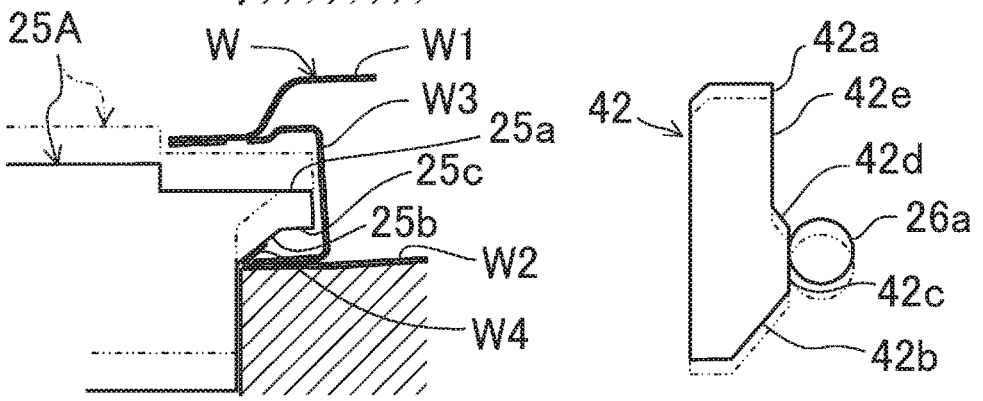
FIG. 9B is a diagram for comparing and explaining a positional relation between the hem punch and the workpiece and a positional relation between the cam driver and the follower, illustrating a state when preliminary hemming is completed.

Because the first hem punch 25A is attached to the cushion holder body 24 with the first slide cam 26 and the first floating-support mechanism 28 interposed therebetween, the first hem punch 25A is pulled downward by the first slide cam 26 and the first floating-support mechanism 28. At this time, because the hem-punch fixing member 28*a* of the first floating-support mechanism 28 engages with the guide rod 28*b*, upper movement of the first hem punch 25A is restricted, and thus the pre-hemming part 25*b* of the first hem punch 25 can be pressed against the bent portion W4 from above. Consequently, the bent portion W4 can be preliminarily hemmed into an intended shape (as depicted in FIG. 4 and FIG. 9B).

During preliminary hemming, although the first slide cam 26 continues to be moved downward, the first hem punch 25A does not move in the forward/backward direction because the cam follower 26*a* of the first slide cam 26 is in contact with the second cam face 42*c* of the first driver cam 42. When the cushion holder 22 has moved downward to the pre-hemming completion position, the lower surfaces of the cushion holder body 24 come into contact with upper-end surfaces of the respective press cutting blocks 30, whereby the cushion holder body 24 is prevented from moving to a position lower than the pre-hemming completion position. Herein, during preliminary hemming, the final-hemming pressing member 43*b* is separated above from the first hem punch 25A, and thus direct pressing force is not applied to the first hem punch 25A.

Figure 5:
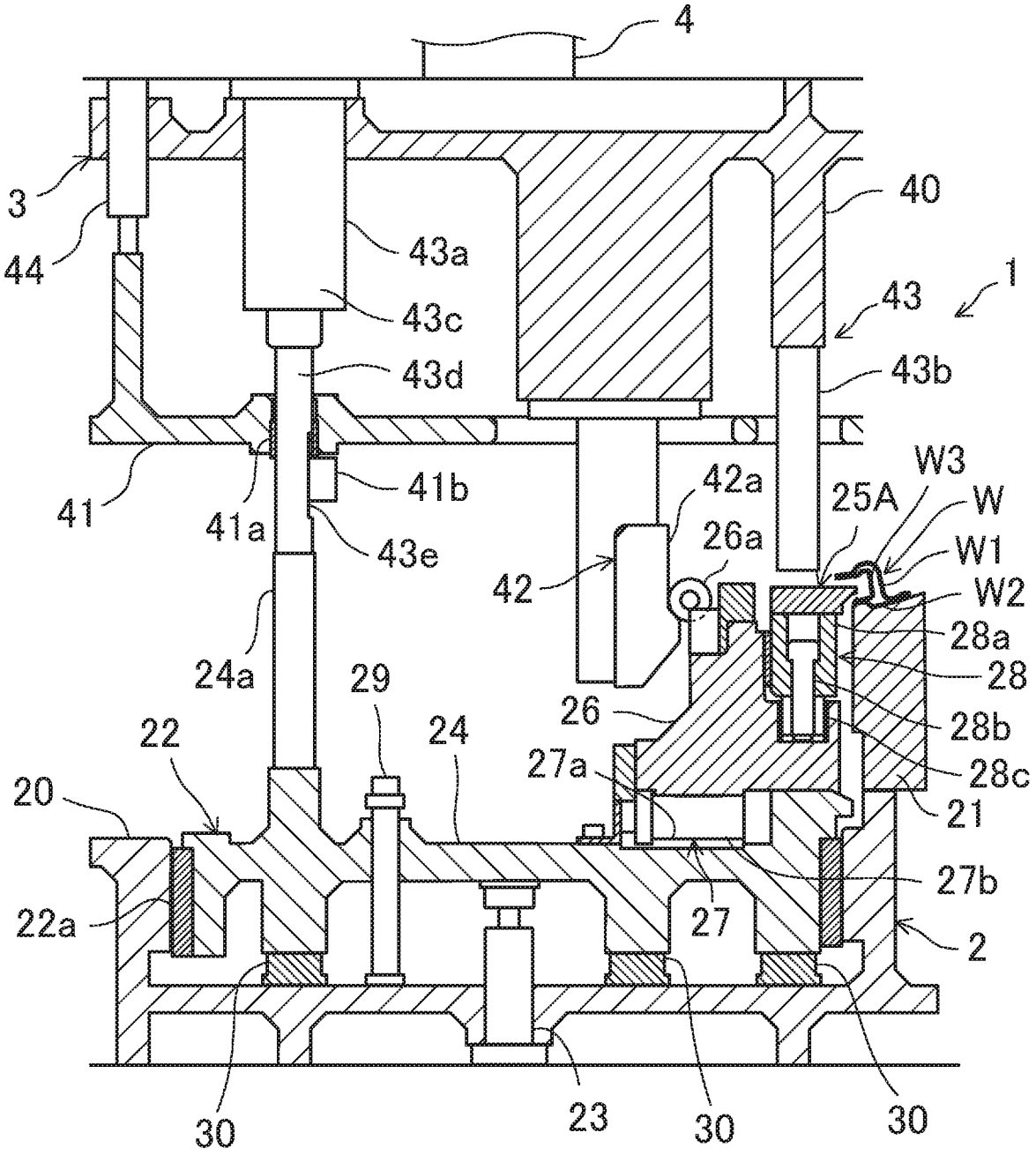
FIG. 5 is a view corresponding to FIG. 1 when the hem punch is at a final-hemming start position.
Figure 6:
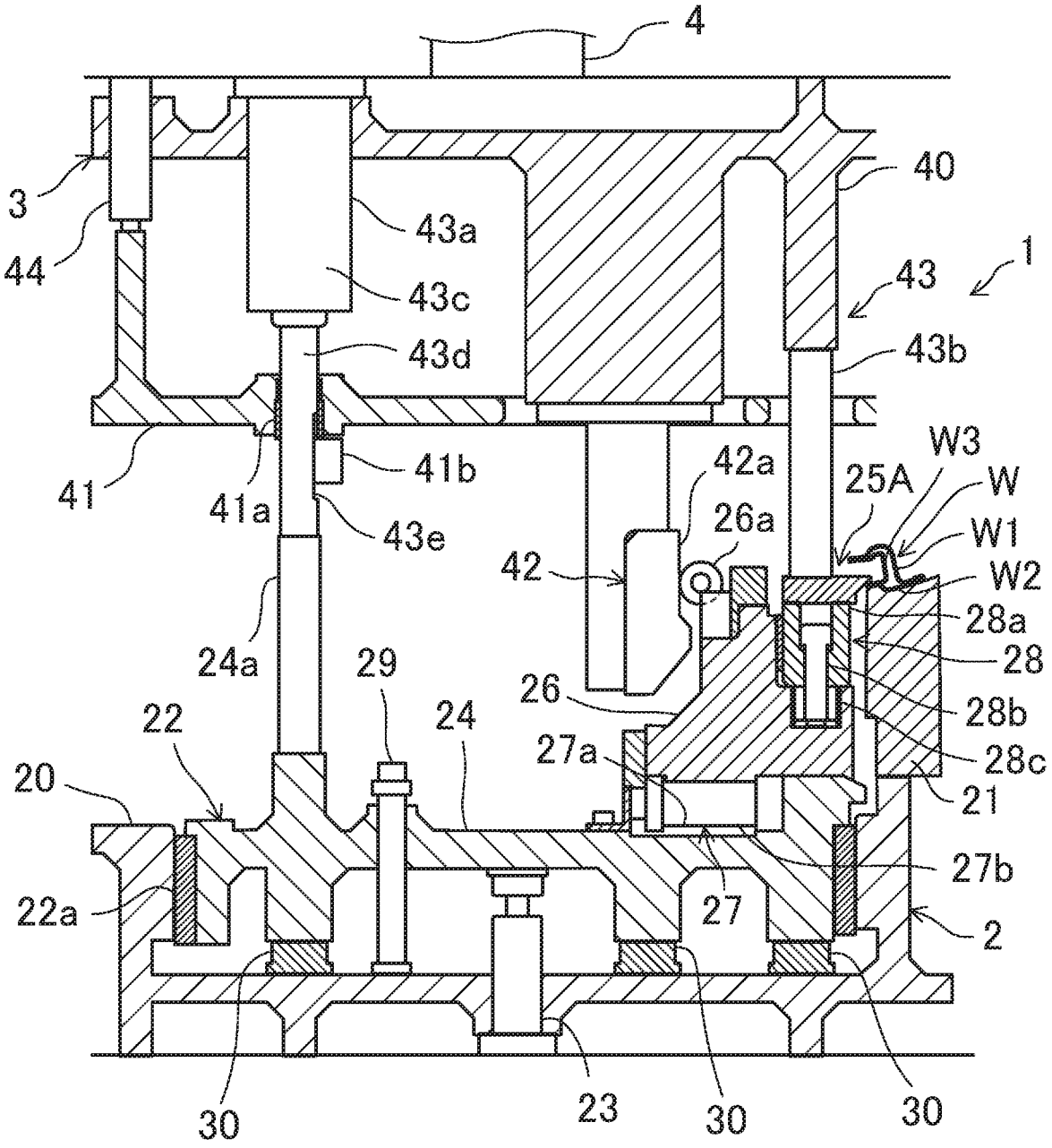
FIG. 6 is a view corresponding to FIG. 1, illustrating a state when final hemming is completed.
Figure 9C:
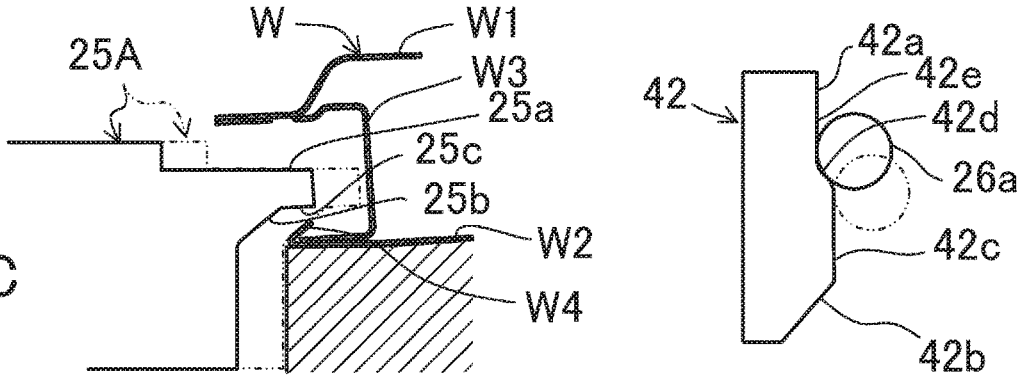
FIG. 9C is a diagram for comparing and explaining a positional relation between the hem punch and the workpiece and a positional relation of the cam driver and the follower, illustrating a state when the hem punch is at the final-hemming start position.
Figure 9D:
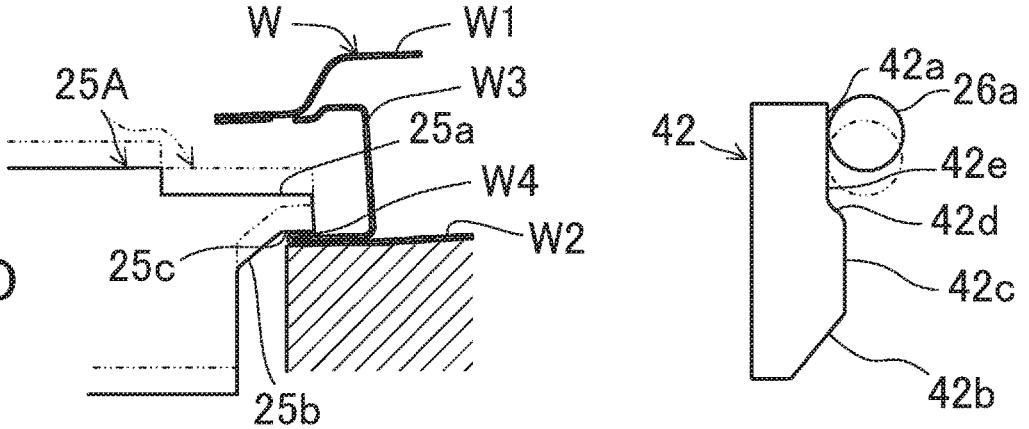
FIG. 9D is a diagram for comparing and explaining a positional relation between the hem punch and the workpiece and a positional relation between the cam driver and the follower, illustrating a state when the final hemming is completed.

Subsequently, when the first slide cam 26 is further moved downward, the cam follower 26*a* of the first slide cam 26 comes into contact with the third cam face 42*d*. This allows the first slide cam 26 to move backward, and accordingly the first slide cam 26 is slid backward by the urging force of the coil spring 27*b* of the first guide mechanism 27, whereby the first hem punch 25A is positioned at the final-hemming start position (as depicted in FIG. 5 and FIG. 9C).

Subsequently, when the upper platen 3 further moves downward, the pre-hemming gas spring 43*c* contracts, and the lower-end portion of the final-hemming pressing member 43*b* presses the upper surface of the first hem punch 25A downward. By this downward pressing force, the first hem punch 25A is displaced downward against the urging force of the coil spring 28*c* because the first hem punch 25A is attached to the first slide cam 26 with the first floating-support mechanism 28 interposed therebetween. Displacement at this time corresponds to the stroke during final hemming, and the final-hemming part 25*c* presses the bent portion W4 from above, whereby the final hemming is completed.

During final hemming, although the first slide cam 26 continues to be moved downward, the first hem punch 25A does not move in the forward/backward direction because the cam follower 26*a* of the first slide cam 26 is in contact with the fourth cam face 42*e* of the first driver cam 42.

Herein, timing when the first pressing mechanism 43 applies processing force to the first hem punch 25A and timing when the second pressing mechanism (not depicted) applies processing force to the second hem punch 25B may be different. Timing for applying processing force can be changed by changing the length of the pre-hemming push bar 43*d* and the length of the final-hemming pressing member 43*b*.

Advantages of Embodiment

With the hemming apparatus 1 according to this embodiment, when a workpiece W is supported by the hemming die 21 and the upper platen 3 is moved in a direction toward the cushion holder 22, the first driver cam 42 engages with the first slide cam 26 and the first slide cam 26 is moved toward the bent portion W4 in conjunction with the first guide mechanism 27, whereby the first hem punch 25A can be positioned at the pre-hemming start position. When the first hem punch 25A is at this pre-hemming start position, by the first pressing mechanism 43, pre-hemming force can be applied to the first hem punch 25A to preliminarily hem the bent portion W4.

After the preliminary hemming, the first driver cam 42 moves the first slide cam 26 backward, whereby the first hem punch 25A can be positioned at the final-hemming start position. When the first hem punch 25A is at the final-hemming start position, by the first pressing mechanism 43, final-hemming force can be applied to the first hem punch 25A. At this time, because the first hem punch 25A is floating-supported to the first slide cam 26, final hemming can be performed by displacing the first hem punch 25A downward without moving the cushion holder body 24.

In other words, when the four-motion hemming apparatus 1 is used, providing the floating-support mechanism 28 for the first hem punch 25A eliminates or reduces the need for providing a first gas spring and a second gas spring that apply reaction force stepwise to the cushion holder as in the conventional example. Thus, variation in inclination of a ram (not depicted) and the upper platen 3 can be prevented or reduced during press stroke.

Furthermore, when the hem punches 25A to 25D are attached to the cushion holder body 24 with the floating-support mechanism 28 interposed therebetween, the hem punches 25A to 25D can be operated individually by the pressing mechanism 43, and thus the press stroke can be easily changed for each of the hem punch 25A to 25D.

The above-described embodiment is merely an example in every respect, and the present disclosure should not be construed as limited to the embodiment. Furthermore, modifications and changes belonging to the scope equivalent to the claims are all within the scope of the present disclosure.

As described in the foregoing, the hemming apparatus according to the present disclosure can be used when a workpiece made of aluminium alloy, for example, is hemmed.

What is claimed is:

1. A hemming apparatus for hemming a bent portion that is formed to rise in a peripheral portion of a workpiece in advance, the hemming apparatus comprising:

a hemming die for supporting the workpiece;

a cushion holder separated from the hemming die and held at a predetermined position by an urging unit having a single urging force; and a drive platen disposed opposite to the cushion holder and configured to be driven in a direction toward or away from the cushion holder, wherein the cushion holder includes: a cushion holder body; a hem punch for hemming the bent portion of the workpiece; a slide cam to which the hem punch is attached; a guide that is attached between the slide cam and the cushion holder body and configured to guide the slide cam in a direction intersecting a rising direction of the bent portion; and a floating support interposed between the hem punch and the slide cam, the floating support being configured to support the hem punch in a floating state relative to the slide cam so that the hem punch is capable of being displaced in a vertical direction from a distal end of the bent portion toward a base end thereof when the hem punch is at a pre-hemming start position, on a base-end side of the hem punch, a pre-hemming part for hemming the bent portion until just before the bent portion is formed into a final shape, and on a distal-end side thereof, a final-hemming part for bending the bent portion thus preliminarily hemmed until the bent portion is formed into a final shape, the drive platen includes a driver cam that engages with the slide cam and a hemming press for applying processing force to the hem punch, the driver cam is configured, driven by the drive platen approaching the cushion holder, to move the slide cam toward the bent portion in conjunction with the guide thereby moving the hem punch to the pre-hemming start position where the pre-hemming part is positioned facing the bent portion, and then move the slide cam backward thereby moving the hem punch to a final-hemming start position where the final-hemming part is positioned facing the bent portion, the hemming press is configured to apply pre-hemming force such that the hem punch is displaced in the vertical direction from the distal end of the bent portion toward the base end thereof by pressing the cushion holder body with a pre-hemming pressing member when the hem punch is at the pre-hemming start position, and directly press the hem punch with a final-hemming pressing member to apply final-hemming force to the bent portion when the hem punch is at the final-hemming start position, and the hem punch is restricted from moving in an opposite pre-hemming direction when the pre-hemming force is being applied, and the hem punch moves in a pre-hemming direction integrally with the cushion holder, and the cushion holder does not move, and the hem punch moves independently from the cushion holder in a final hemming direction when the final hemming force is being applied.

2. The hemming apparatus of claim 1, wherein the floating support includes a coil spring for urging the hem punch in an opposite pre-hemming direction.

3. The hemming apparatus of claim 2, wherein the hemming die is formed so as to support a vehicle door having a sash as the workpiece, a plurality of hem punches, including the hem punch, are disposed inside the sash, and each hem punch is formed so as to preliminarily hem and finally hem one of bent portions formed in an inner peripheral portion of the sash.

4. The hemming apparatus of claim 1, wherein the hemming die is formed so as to support a vehicle door having a sash as the workpiece, a plurality of hem punches, including the hem punch, are disposed inside the sash, and each hem punch is formed so as to preliminarily hem and finally hem one of bent portions formed in an inner peripheral portion of the sash.

* * * * *